US011530074B2

(12) United States Patent
Bangalore et al.

(10) Patent No.: US 11,530,074 B2
(45) Date of Patent: Dec. 20, 2022

(54) MATERIAL HANDLING PALLET

(71) Applicants: Venkataramu Bangalore, Chatsworth, CA (US); David Friedman, Chatsworth, CA (US)

(72) Inventors: Venkataramu Bangalore, Chatsworth, CA (US); David Friedman, Chatsworth, CA (US)

(73) Assignee: NOBLE HOUSE HOME FURNISHING, LLC, Chatsworth, CA (US)

( * ) Notice: Subject to any disclaimer, the term of this patent is extended or adjusted under 35 U.S.C. 154(b) by 0 days.

(21) Appl. No.: 17/324,700

(22) Filed: May 19, 2021

(65) Prior Publication Data

US 2021/0362905 A1 Nov. 25, 2021

Related U.S. Application Data

(60) Provisional application No. 63/027,479, filed on May 20, 2020.

(51) Int. Cl.
*B65D 19/00* (2006.01)
*B65D 19/38* (2006.01)

(52) U.S. Cl.
CPC ..... *B65D 19/0046* (2013.01); *B65D 19/38* (2013.01); *B65D 2203/10* (2013.01); *B65D 2519/00273* (2013.01); *B65D 2519/00288* (2013.01); *B65D 2519/00308* (2013.01); *B65D 2519/00323* (2013.01); *B65D 2519/00363* (2013.01)

(58) Field of Classification Search
CPC ..... B65D 19/38; B65D 19/42; B65D 2519/00363
USPC ..... 108/51.11, 52.1, 57.29, 57.32
See application file for complete search history.

(56) References Cited

U.S. PATENT DOCUMENTS 3,835,792 A * 9/1974 Wharton ..... B65D 19/0038 108/56.1
3,964,400 A * 6/1976 Brand ..... B65D 19/0012 108/57.25
4,843,976 A * 7/1989 Pigott ..... B65D 19/0012 24/453
5,413,052 A * 5/1995 Breezer ..... B65D 19/0012 108/57.33

(Continued)

FOREIGN PATENT DOCUMENTS

EP 1382533 A2 * 1/2004 ..... B65D 19/0012
WO WO-2008047353 A1 * 4/2008 ..... B65D 19/38
WO WO-2010007621 A1 * 1/2010 ..... B65D 19/38

*Primary Examiner* — Jose V Chen
(74) *Attorney, Agent, or Firm* — Colin P. Abrahams

(57) ABSTRACT

A pallet comprises an upper load supporting surface having a peripheral edge, and a lower surface having a peripheral edge. The lower surface has substantially the same dimensions as the upper load supporting surface. A plurality of peripheral supports are provided at or near the peripheral edge of the lower surface and extend upwardly therefrom to the upper load supporting surface so that the upper load supporting surface and the lower surface are spaced from each other and define sides of the pallet. Each side of the pallet has a first opening and a second opening which are defined by the upper load supporting surface, the lower surface, and a pair of peripheral supports. Inclined surfaces are provided on the lower surface.

20 Claims, 11 Drawing Sheets

(56) References Cited

U.S. PATENT DOCUMENTS 6,006,677 A * 12/1999 Apps ..... B65D 19/0012 108/57.33
6,138,582 A * 10/2000 Fujii ..... B65D 19/0069 108/57.25
6,199,488 B1 * 3/2001 Favaron ..... B65D 19/0012 108/57.25
6,809,703 B2 * 10/2004 Serra ..... G06K 19/07784 340/572.1
6,814,287 B1 * 11/2004 Chang ..... B65D 19/38 235/492
8,770,115 B2 * 7/2014 Apps ..... B65D 19/0004 108/57.25
2003/0061974 A1 * 4/2003 Smyers ..... B65D 19/0012 108/57.33
2003/0233963 A1 * 12/2003 Fan ..... B65D 19/0012 108/51.11
2004/0216648 A1 * 11/2004 Apps ..... B65D 19/0012 108/57.25
2005/0107092 A1 * 5/2005 Charych ..... G06K 17/00 455/456.1
2006/0212165 A1 * 9/2006 Watanabe ..... G06Q 10/08 340/572.1
2006/0254474 A1 * 11/2006 Roth ..... B65D 19/0095 108/51.11
2008/0210140 A1 * 9/2008 Valentinsson ..... B65D 19/0014 108/51.11
2009/0050029 A1 * 2/2009 Ogburn ..... B65D 19/0012 108/51.11
2009/0114129 A1 * 5/2009 Smith ..... B29C 70/865 108/57.25
2010/0288169 A1 * 11/2010 Du Toit ..... B65D 19/0004 108/57.25
2011/0126741 A1 * 6/2011 Sosa Bravo ..... B65D 19/0038 108/57.25
2012/0325125 A1 * 12/2012 Apps ..... B65D 19/0014 108/51.11
2016/0068302 A1 * 3/2016 Clark ..... B65D 19/0085 108/57.32
2018/0141706 A1 * 5/2018 Storteboom ..... B65D 19/385
2018/0322453 A1 * 11/2018 Lantz ..... G06Q 10/087
2019/0168912 A1 * 6/2019 de Bokx ..... B65D 19/0012
2020/0031522 A1 * 1/2020 Shawaf ..... B29C 41/04
2021/0188482 A1 * 6/2021 Meiring ..... B65D 19/38

* cited by examiner

MATERIAL HANDLING PALLET

CROSS REFERENCE TO RELATED APPLICATIONS

This application claims the benefit of U.S. Provisional Patent Application No. 63/027,479 filed on May 20, 2020, the contents of which are incorporated herein by reference in their entirety.

FIELD AND BACKGROUND OF THE INVENTION

This invention relates to a material handling pallet and pallet system. More particularly, the invention is for a pallet and pallet system having structure and features which facilitate easier inventory control, management and movement, as well as the movement of such inventory through various stages, including manufacture, storage and transportation.

Further, the present invention relates to the design and implementation of a material handling accessory, which may be in the form of a pallet and pallet system.

SUMMARY OF THE INVENTION

According to one aspect of the invention, there is provided a pallet comprising: an upper load supporting surface having a peripheral edge; a lower surface having a peripheral edge, the lower surface having substantially the same dimensions as the upper load supporting surface; a plurality of peripheral supports at or near the peripheral edge of the lower surface and extending substantially upwardly therefrom to the upper load supporting surface so that the upper load supporting surface and the lower surface are spaced from each other and define sides of the pallet; at least one internal support extending upwardly from the lower surface to the upper load supporting surface; each side of the pallet having a first opening and a second opening adjacent to the first opening, each of the first and second openings being defined by the upper load supporting surface, the lower surface, and a pair of peripheral supports; and inclined surfaces on the lower surface.

Preferably, the upper load supporting surface is directly above the lower surface, and spaced therefrom by the peripheral supports. Further, the upper load supporting surface may comprise a grid over at least a portion of its surface. The lower surface may comprise four outer pieces arranged at right angles to each other to form a rectangle, a first transverse piece extending between two opposite outer pieces and a second transverse piece extending between two other opposite outer pieces, the first transverse piece and the second transverse piece crossing and connected to each other at an approximate midpoint of the pallet.

At least some of the peripheral supports may be located at a corner of the pallet, and there may be a center column support extending between the lower surface and the upper load supporting surface, such that the center column support is located at substantially the midpoint between a pair of the peripheral supports.

In one preferred embodiment, the inclined surfaces on the lower surface are formed on the four outer pieces, the first transverse piece, and the second transverse piece, the inclined surfaces being positioned on a travel pathway of a fork lift.

Preferably, the first opening and the second opening have an elongate rectangular configuration, and the upper load bearing supporting surface and the lower surface at the first opening and the second opening have inclined surfaces. There may be an internal column extending between the lower surface and the upper load supporting surface, the internal column having a height so that it maintains the size of the space therebetween and provides additional support to the upper load supporting surface. The upper load bearing surface and the lower surface may be rectangular in shape, and the first opening and the second opening are located in all four of the sides of the pallet. The pallet may be comprised of materials selecting from the group consisting of plastic, wood, metal, or a combination of such materials.

In one embodiment, the first opening and the second opening are of elongate rectangular shape, wherein the corners thereof are beveled, and inclined surfaces are formed surrounding the first opening and the second opening to facilitate ingress and egress of a forklift entering the first opening and the second opening.

The pallet may further comprise an electronic tag programmable with information relating to location, load, and other parameters.

According to a further aspect of the invention, there is provided a method of making a pallet comprising: providing a lower surface; placing an upper load bearing surface over the lower surface such that the lower surface and the upper load bearing surface are spaced from each other, the upper load bearing surface and lower surface forming sidewalls of the pallet; placing peripheral support members between the lower surface and the upper load bearing surface to maintain the spaced relationship, the peripheral support members having sufficient strength to support loads placed on the upper load bearing surface; forming a first opening and a second opening in all of the sidewalls, the first opening and the second opening comprising a travel pathway for the ingress and egress of forks on a forklift machine; and providing ramps or inclined surfaces in the first opening and second opening at least on the lower surface on the travel pathway to facilitate ingress and egress of the forks.

Pallets and similar types of structures and devices are a common platform tool used in product storage and transportation. A pallet is a transport structure which has an upper generally flat receiving surface or platform which supports containers, boxes, and other goods in a stable fashion. The pallet has below the flat receiving surface a space or chamber which is sized and dimensioned to receive the lifting forks of a forklift or other type of vehicle which may be inserted freely in the space to raise and lower the pallet, and effect movement of the pallet and the loads mounted thereon. The forklift vehicle can raise or lower the lifting forks, usually by means of hydraulic operations, at the same time raising or lowering the pallet and the containers thereon. In this way, the forklift vehicle transports or moves the loaded pallet and containers thereon, when raised, between selected designated sites, as the pallet and container combination moves through its stages from manufacture to storage and even to commercial or residential locations thereafter. Upon completion of such an operation, the pallet is once more available for future use to facilitate easier movement of other products or loads.

The pallet is thus a structural foundation of a unit load which facilitates handling and storage efficiencies. Pallets may come in many sizes and shapes, although standard sizes and shapes have evolved into commercial use over time. For example, one standard size pallet may have dimensions which are 48"×40", but other standard or commonly used sizes may certainly be used according to need and context. Further, custom sized pallets may be created and used for products which may need specialized types of handling.

Containerization of material and product transportation has in fact spurred the use of pallets more than ever because of efficiency, as well as secure material handling. In today's world, pallets can handle a static load of more than several thousand pounds. Materials can be stored and loaded onto pallets, and moved from one different geographical location to another with relative ease. Today, it is estimated that about half a billion pallets are made each year and about two billion pallets are in use across the United States alone.

There are different kinds of pallets based on the application and nature of the containers and products which will be placed on the pallet for storage and transportation. Further, pallets may be made out of many types of materials, or combinations thereof, but most are manufactured from molded plastic resin, extruded plastic, or wood. Combinations of such materials may also be used. Pallets also comes in various sizes such as, as noted above, a standardized 40"×40", as well as other standard sizes including 40"×48", 40"×72" or 40"×96". While certain pallets may be designed for use in areas which allow automated storage and retrieval, not all pallets can be used in such areas and may not be suitably constructed and configured to be useful where automated storage and retrieval systems may be used.

Pallets used in automated storage and retrieval locations may utilize, for example, an automated guided vehicle (AGV) pallet jack as shown in FIG. 1 and FIG. 2 of the drawings, or they may be appropriate for use where an order picker cart (OPC) is utilized, as shown in FIG. 3 and FIG. 4 of the drawings. Note that other jacks or vehicle types may also be used, and the invention is not limited to a pallet which may be moved by any specific transportation device or machine.

DETAILED DESCRIPTION OF THE INVENTION

The pallet of the present invention is comprised in whole or in part of plastic, although it may be made of other materials as well such as wood or metal or combinations of such materials, and may include and encompass areas or portions thereof where it may be compatible to use in automated storage and retrieval systems using both AGV's and OPC's, as well as other systems and vehicles, where applicable, utilized in the movement, storage and transportation of material mounted on pallets. Not all pallets currently available in the market are capable of handling or working within these systems with ease, or at all. The design of the pallet in accordance with the present invention is, however, preferably capable of handling these systems. The pallet of the invention may be made by having specific critical dimensions so to be compatible with or within the range of the machine or the type of equipment that is used in the particular system.

An illustration of one embodiment of a pallet in accordance with the present invention is seen in FIGS. 5, 6, 7 and 8 of the accompanying drawings, as will be described in further detail below.

Figure 2:
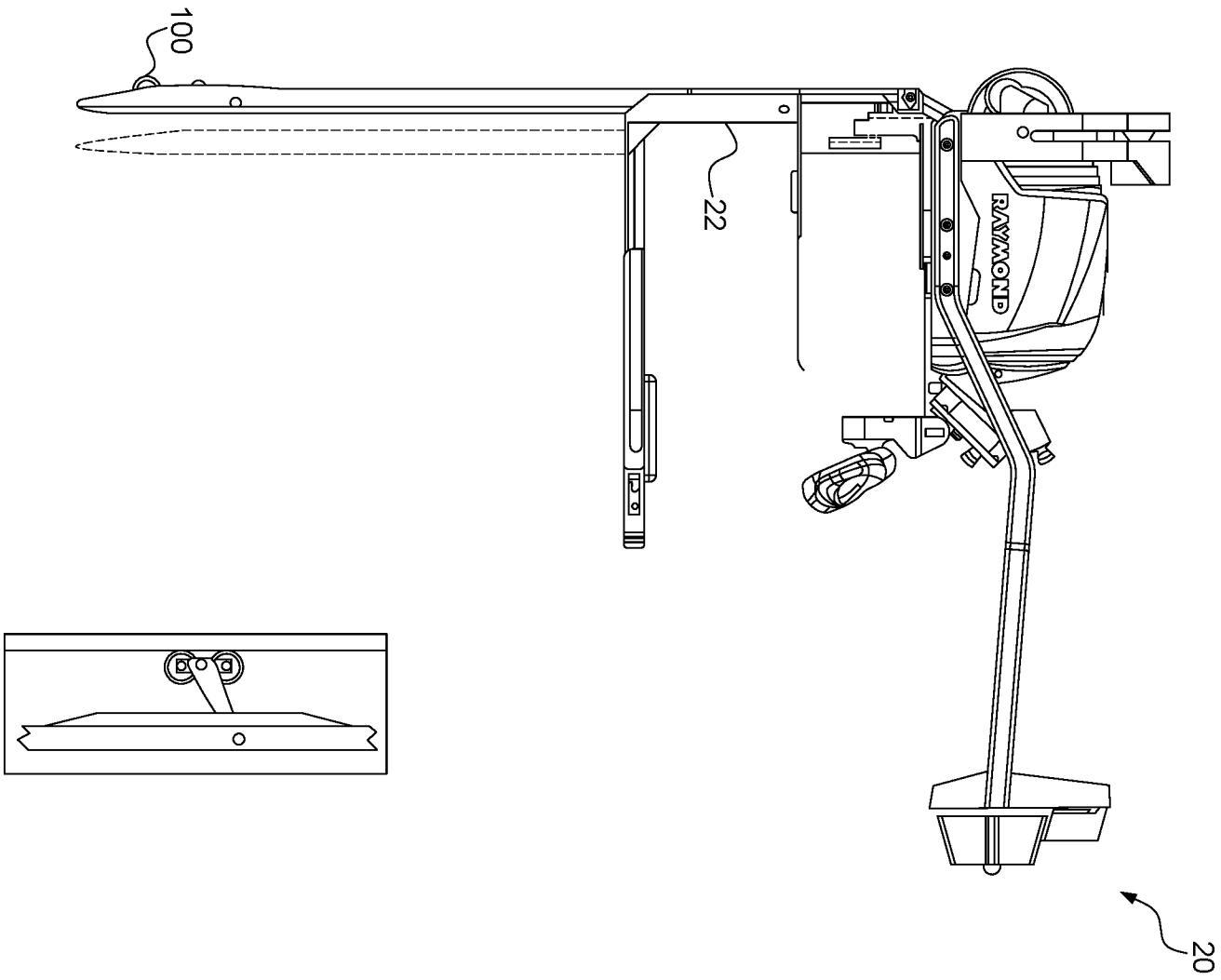
FIG. 2 is a side view of the automated guided vehicle as shown in FIG. 1 of the drawings.
Figure 4:
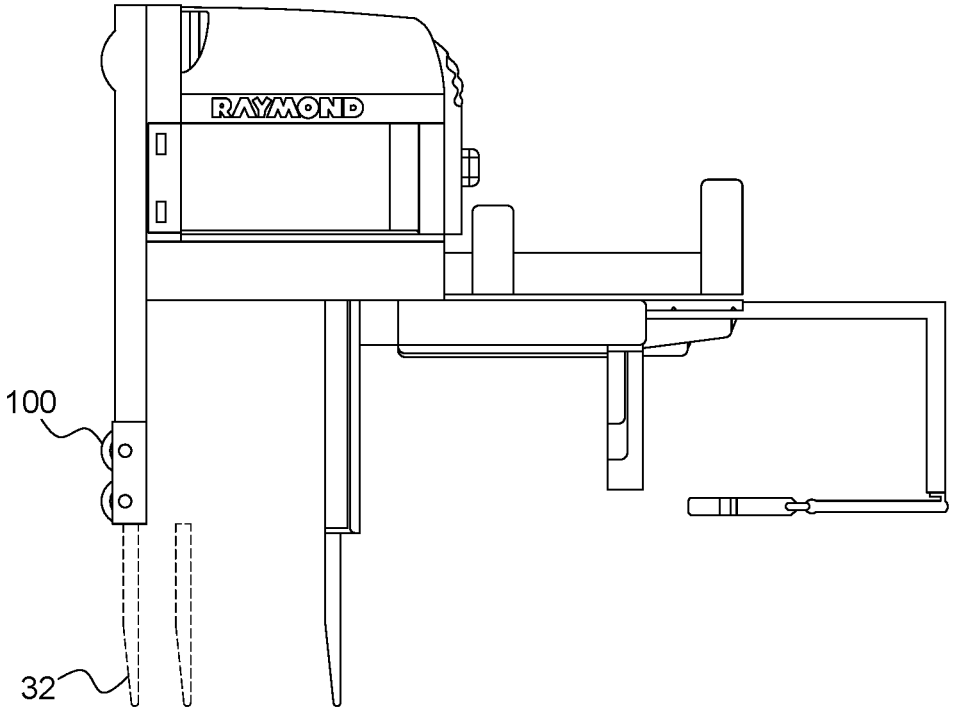
FIG. 4 is a side view of the order picker cart shown in FIG. 3 of the drawings.

The AGV and OPC vehicles both have wheels, as seen for example in FIG. 2 and FIG. 4 of the drawings. It is necessary that these wheels are able to enter into the pallet from the side thereof, and thereafter be withdrawn therefrom with ease, through the applicable spaces in the pallet, typically below the load surface thereof. The configuration must also be such so as to ensure that the pallet is able to be dropped off, when empty and no longer supporting a load or container, at a defined location in the warehouse or at some other storage site. These are the required features for a pallet to be properly and successfully used in an automated storage and retrieval system.

Figure 8:
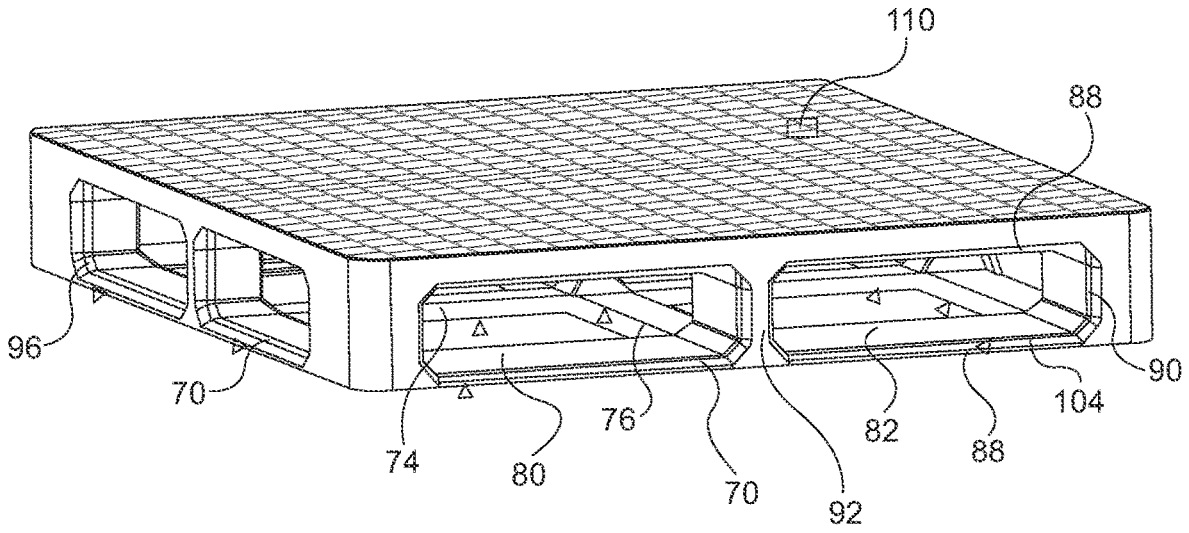
FIG. 8 is a top perspective view of a pallet in accordance with one aspect of the invention.

The pallet of the present invention, in one embodiment, has features and structure as shown, for example, in FIG. 8 of the drawings, as well as various other figures, where it will be seen that the entry angle, including the wheel entry angle, and the thickness of the wall, of the pallet are both designed in such a way that the AGV and the OPC or other vehicle can enter through the space under the load bearing surface, and exit the space when the forklift is withdrawn or moved away after movement of the pallet. The AGV and OPC vehicles also can drop off the empty pallets at a defined or programmed location. The pallets can, furthermore, be used in a pallet dispenser comprising a structure housing for storing a plurality of pallets, for an AGV or other type of vehicle or machine to pick up for loading. Pallets having these features may not currently be available on the pallets in the market.

Figure 3:
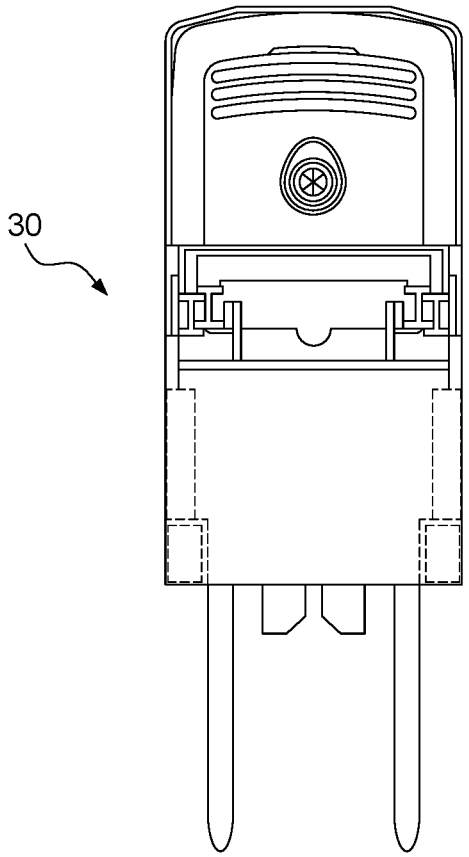
FIG. 3 is a top view of an order picker cart (OPC) for use with a pallet in accordance with the present invention.
Figure 9:
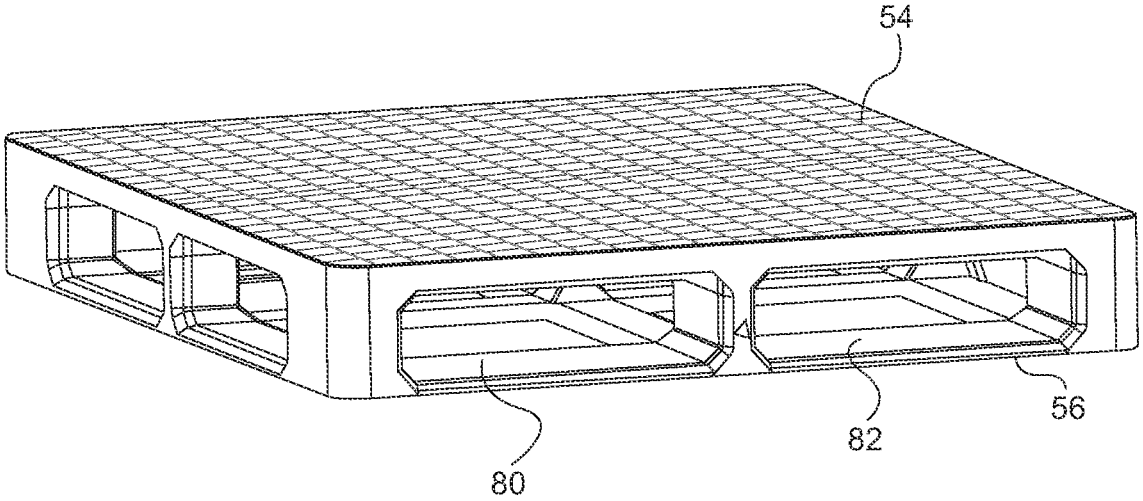
FIG. 9 is a top perspective view of a pallet in accordance with one aspect of the invention, including the area where a vehicle fork is able to hold the pallet.

As mentioned earlier, the pallet in accordance with the invention can be used in the retrieval of stored products or boxes. In order to do this, it is necessary that the AGV or the OPC or other vehicle or machine type is able to grab the pallet using its fork. The dimensions of the pallet are therefore critical in order for it to function as intended. This is illustrated in FIG. 3 of the drawings, and reference is made to the arrow pointing to the fork for the dimension "U." This is a crucial dimension in the OPC which enables it to connect with and hold the pallet at the area shown in FIG. 9 of the drawings.

These areas are preferably configured in such a way that when the forks of the OPC or other conveyor or vehicle component are in the range of the machine, they are able to hold the pallet with its full load. This is one of the unique features of the pallet.

Figure 1:
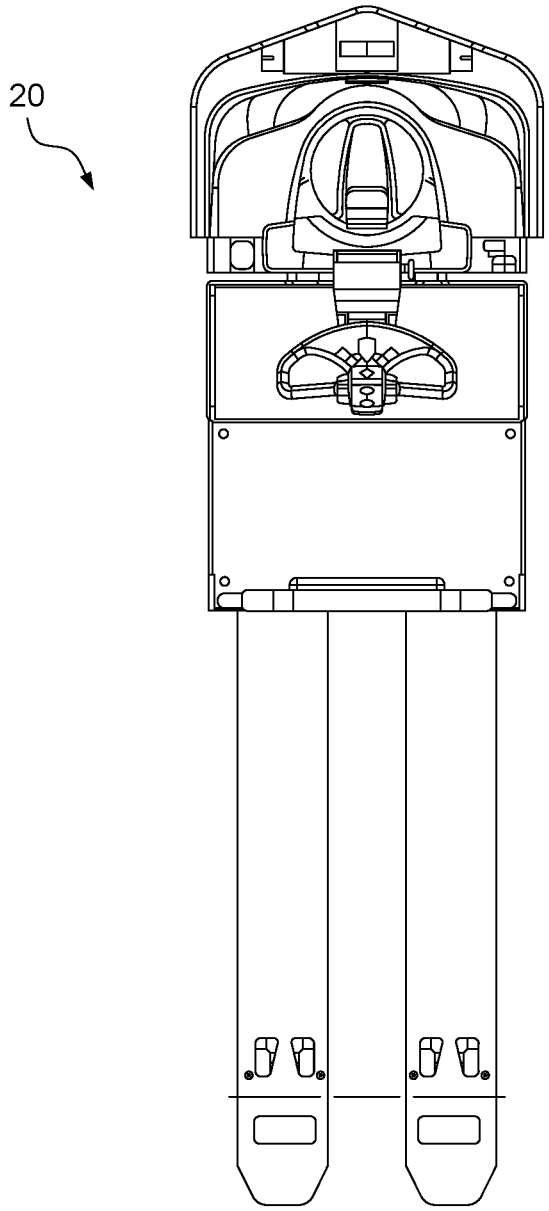
FIG. 1 is a top view of an automated guided vehicle (AGV) for use with a pallet in accordance with the present invention.

FIG. 1 of the drawings shows an automated guided vehicle (AGV) 20 in top view. FIG. 2 of the drawings shows this AGV 20 in a side view. These two figures illustrate one of the vehicles which may be utilized in engaging with a pallet of the invention, so that the pallet may be raised or lowered, and when lifted onto the vehicle can be moved from one position to another, as desired. The AGV 20 has various controls and machinery for raising and lowering forks 22 which engage the pallet. In FIG. 2 of the drawings, the height distance AA shows a height which may be about 5.8 inches extending from the floor to the bottom of the battery rollers, with the forks lowered, and which may increase to about 11.8 inches when the forks are raised. These distances are examples and the invention is not limited thereby.

The height distance represented by AB in FIG. 2 may be about 8.1 inches in one embodiment from the floor to the top of the battery rollers with the forks lowered, and about 14.1 inches with the forks raised.

FIGS. 3 and 4 of the drawings show another type of transport vehicle, namely, an order picker cart (OPC) 30 in top view and side view respectively. This vehicle 30, too, includes a forklift 32 which engages a pallet in accordance with the invention by moving toward or away from it, as will become apparent from the description below. The pallet of the invention is configured for optimal use with vehicles such as those described in these figures, so that loads mounted on the pallet can be efficiently and effectively transported by these and other types of vehicles which are specially adapted for such operations.

Figure 5:
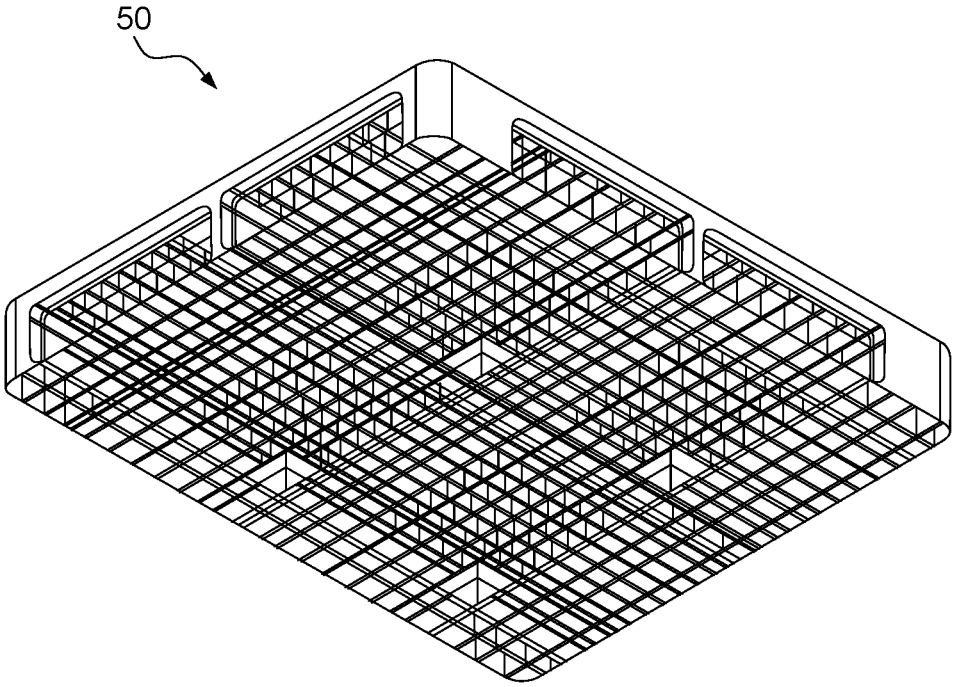
FIG. 5 is a bottom perspective view of a pallet in accordance with one aspect of the invention.
Figure 6A:
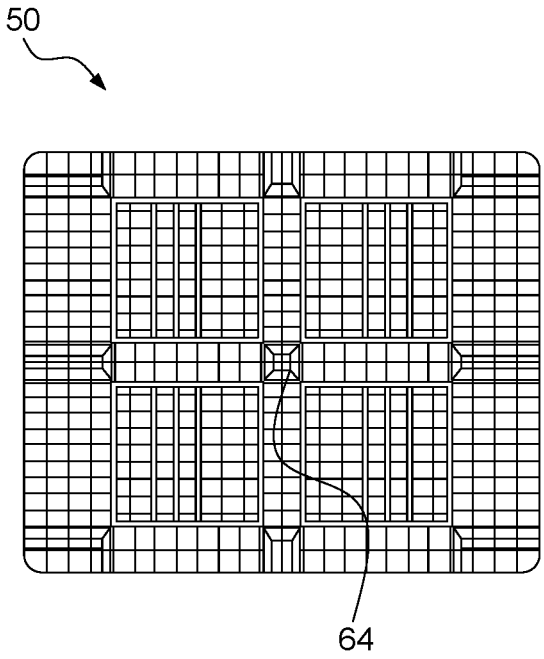
FIGS. 6A, 6B, 6C and 6D show top, cross section, detail cross section of corner, and side views of a preferred pallet constructed in accordance with one aspect of the present invention.
Figure 6B:
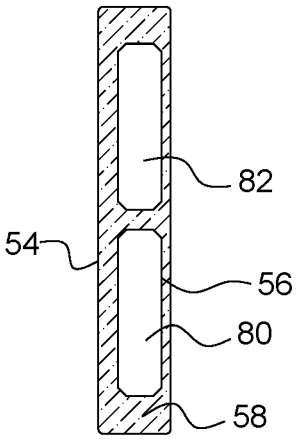
Figure 6C:
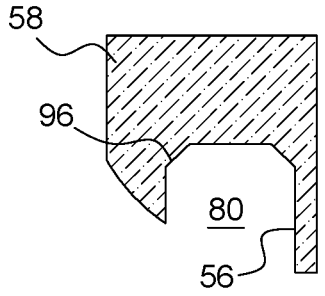
Figure 6D:
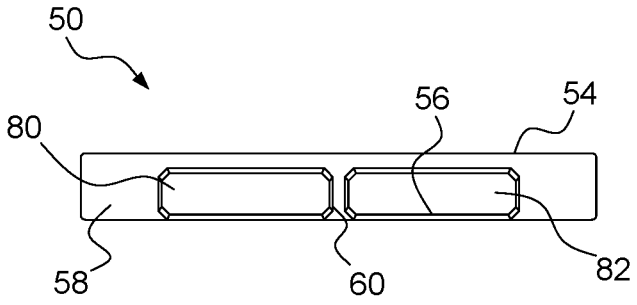
Figure 7:
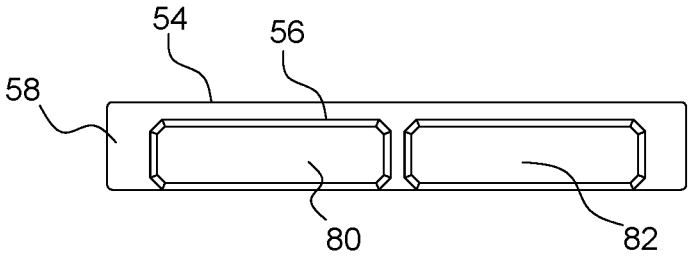
FIG. 7 is a detailed front view of a pallet in accordance with the invention indicating measurements of one preferred embodiment of the invention.

FIG. 5 of the drawings shows a top perspective view of a pallet 50 in accordance with one aspect of the invention. FIGS. 6A, 6B, 6C and 6D show respectively a top view of such pallet 50 as well as an end view thereof, a cross-section through A-A, a detailed cross-section of one end, and an end view. FIG. 7 of the drawings is a larger detailed view of another embodiment of the invention.

The pallet 50 has an upper surface 54, upon which loads may be placed, and a lower surface 56. The upper surface 54 and the lower surface 56 are spaced from each other. Four corner pieces 58, each at a corner of the pallet 50, connect the upper surface 54 to the lower surface 56 of the pallet 50, and have sufficient strength to ensure that the upper surface 54 does not collapse under the weight of any load which is mounted on the upper surface 54. Additionally, intermediate each of the corner pieces 58 there is located a center column 60. There are four such center columns 60, approximately but not necessarily centered between each of the corner pieces 58 on the outside edge of the pallet 50. Each of the center columns 60 also have sufficient strength to provide adequate support and maintain the distance between the upper surface 54 and the lower surface 56 so as to prevent collapsing of the upper surface 54 under the weight of a load which may be mounted thereon. It will be appreciated that pallets 50 may be constructed so as to have different strength characteristics, for use in different situations. Some pallets 50 which are intended to carry only smaller or lighter loads need not necessarily be as strong and robust as other pallets 50 which are intended to carry heavier loads.

The pallet 50, additionally, comprises an internal column 64 for supporting and maintaining the distance between the upper surface 54 and a lower surface 56 of the pallet in the approximate center of the pallet 50.

It will be seen that the upper surface 54 of the pallet 50 is generally continuous and extends over the entire area of the upper surface 54. The upper surface 54 may be of a grid like configuration, providing a substantially continuous surface, but also including a plurality of spaces in the grid like pattern, so that it can effectively support a load which is placed thereon.

The lower surface 56 of the pallet 50 comprises four outer edge pieces 70 (see FIG. 8 for example), each arranged substantially perpendicular or at right angles to each other, and defining a square or rectangular shape. Additionally, the lower surface 56 comprises a first transverse piece 74 which extends between two opposing center columns 60. The lower surface 56 further comprises a second transverse piece 76 which extends between the other two opposing center columns 60. The first transverse piece 74 and the second transverse piece 76 cross each other at approximately the center of the lower surface 56 of the pallet 50. Thus, the first transverse piece 74 is substantially parallel to and intermediate a pair of opposing outer edge pieces of 70, while the second transverse piece 76 is substantially parallel to and intermediate the other pair of opposing outer edge pieces 70. The point at which the first transverse piece 74 and the second transverse piece 76 cross each other constitutes the position at which the internal column 64 is mounted. This internal column 64 therefore extends upwardly from this crossing point of the transverse pieces 74 and 76 on the lower surface 56 to the upper surface 54. A central support mechanism between the lower surface 56 and the upper surface 54 is therefore provided as well.

Along each side of the pallet 50, there are two side-by-side spaces, namely, a first space 80 and a second space 82. On each side, the first space 80 is between a corner piece 58 and one of the center columns 60, while the second space 82 is between the same center column 60 and an opposing corner piece 58. In a preferred embodiment, each of the first and second spaces 80 and 82 are each of substantially identical dimensions. These dimensions may vary from one pallet 52 another depending upon the type of vehicle, and the forklift of the vehicle, which is intended to engage the pallet 50. However, in practice, they are standard size forklifts and the first and second spaces 80 and 82 will therefore be configured to fit one of these standard sizes.

The spaces 80 and 82 are the openings through which the fork of the vehicle will enter. The center column 60 will typically constitute an abutment surface for the fork and its adjacent parts to prevent the fork from entering the pallet 50 any further.

Each of the spaces 80 and 82 is a generally rectangular shape, and has an upper edge 86 and a lower edge 88. Further, each of the spaces 80 and 82 has a first side edge 90 and a second side edge 92. Each of the corners preferably has a chamfered or beveled portion 96 between the lower edge 88 and the first and second side edges 90 and 92, as well as between the upper edge 86, and the first and second side edges 90 and 92. In a typical transport vehicle for moving loads on pallets, the vehicle will include a pair or bifurcated forks in the front thereof, and each of said pair of forks would be received in one of the spaces 80 and 82.

It will further be seen that ramped or inclined surfaces are provided at various locations on the pallet 50 to facilitate the easier positioning of the transportation vehicle with respect to the pallet 50. As seen in FIGS. 1 to 4, as briefly described above, the lifting forks may typically be supported by small wheels 100, and it is of course beneficial when the wheels do not encounter any obstacle which may impede or prevent further forward motion of the forks or the transportation device. As such, at least the lower edge 88 has a ramp 104 or incline making it easier for the wheels to continue with unobstructed forward movement when encountering the outer edge pieces 70 of the lower surface 56 of the pallet. The ramp 104 presents far less of an impediment to movement that would a vertical wall of the part with sharp edges. In other embodiments, such inclines or ramps may further be provided on the first and second side edges 90 and 92, as well as on the upper edge 86. In this way, ingress of the forks to the first and second spaces is facilitated. Furthermore, an incline or ramp 104 will also be present on the inside of the outer edge pieces 70 so that when the fork and the wheels are moved away from or out of the pallet 50, to the extent necessary any wheels on the forks will glide more easily over the outer edge pieces 70 and thereby create less of an obstacle or impediment resulting in a smoother egress.

It will also be noted that the first transverse piece 74, as well as the second transverse piece 76, also have inclined or ramp type edges for improved operation, as described above, so that a vertical wall and sharp edges or corners are not encountered during ingress and egress of the fork.

In preferred embodiments, the pallets have specific measurements, as indicated above, although in terms of overall width, depth and height, many of these measurements may be fairly standard. With respect to the apertures 80 and 82, the invention provides for preferred sizes and dimensions, and some of these specific amounts are provided as set out in FIGS. 6 and 7 of the accompanying drawings. The measurements given in FIG. 6 will typically be applicable in a pallet with a width of 48 inches and a depth of 40 inches, while the measurements given in FIG. 7 are slightly different and may be for a smaller size pallet.

It will be noted that each side of the pallet 50 is configured so as to have the two spaces 80 and 82 so that the forks of the forklift vehicle will have similar access to the pallet 50 from whichever side the vehicle is approaching the pallet, thus rendering to the pallet 50 a convenience of use regardless of relative positions or orientations.

As mentioned, and further described below, each of the pallets 50 may be used in association with an electronic device which will facilitate identification of a specific pallet 50, provide information as to its position or location, and may also be updated and programmed so as to include information about the goods or products which are currently loaded on the pallet 50, providing users with useful and essential information during the course of a period of storage or transportation.

The electronic devices may take different forms, although one preferred embodiment may utilize radio frequency identification devices, typically known as RFID devices. As described further below, these RFID devices associated with the pallet may be active in nature and temporarily accommodated within a specific housing of the pallet 50, such as at 110, or clamped or strapped thereto in a manner which keeps it secure until it needs to be removed. Such an RFID device may typically follow a load from one position or location to another, including its location on pallets 50 during such movements. The electronic devices may also be passive RFID's, wherein they are connected or molded to the pallet in a more permanent manner so as to be a part of the structure, and capable of being programmed electronically with the relevant information as different loads and containers are moved on the pallet. Such electronic devices may also include the necessary power sources, be rechargeable, and be connectable wirelessly such as through Internet routers or Bluetooth, so that the position of the pallet 50 and its load can be more easily determined and followed as it moves through the system.

Figure 10:
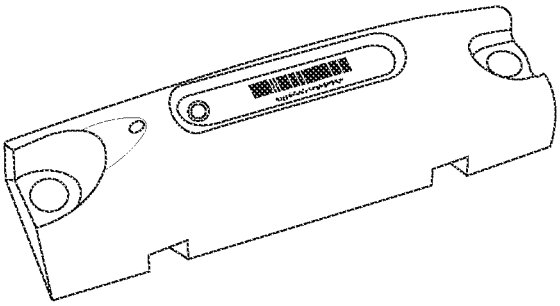
FIG. 10 is a perspective view of an active type electronic tag for use with a pallet in accordance with the invention.
Figure 11:
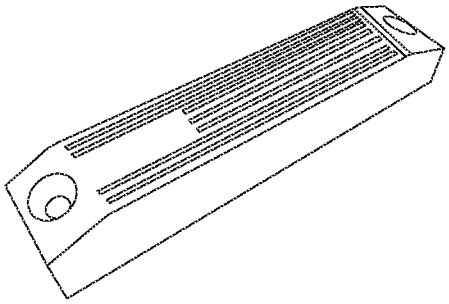
FIG. 11 is a perspective view of another active type electronic tag for use with a pallet in accordance with the invention.
Figure 12:
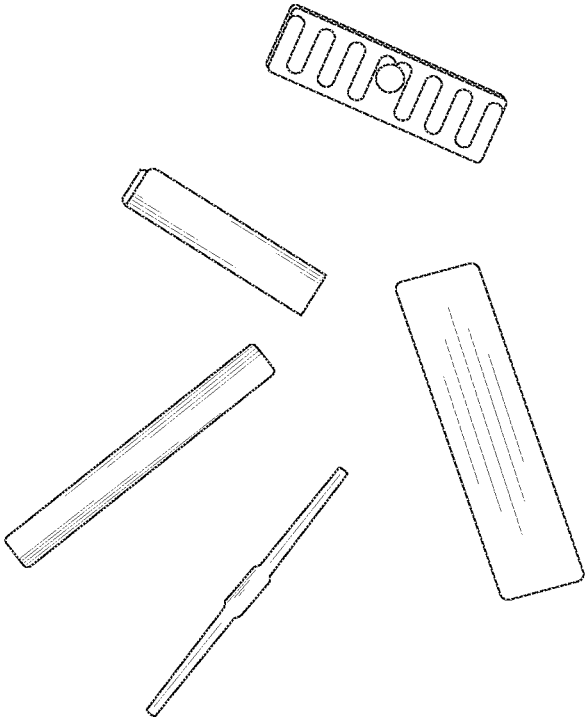
FIG. 12 shows a representative plurality of passive electronic devices for use with a pallet in accordance with the invention.

FIGS. 10 and 11 each illustrate an RFID device which may be considered of the active variety, and releasably attached to the pallet 50. These may travel with the load, and be associated with the load, as the load moves through different shipping areas and locations. FIG. 12 of the drawings illustrate RFID devices which may be considered of the passive variety, and which may be permanently attached to the pallet 50, or molded within chambers, such as 110 in FIG. 8 of the drawings, contained within the pallet 50, and re-programmable when the load on the pallet 50 changes, as one load may be removed, the pallet 50 is recycled or stored, and/or new loads are positioned thereon.

One embodiment of the pallet and system of the invention therefore provides the pallet of the invention to have the ability to incorporate RFID (radio frequency identification) tags, or other types of identifying or tracking and electronic devices. The loss of pallets and poor inventory management is one of the more significant contributors to lost revenue for any organization in this field. The pallets and systems of the invention are designed to accommodate these tags which will help to overcome the above problem and contribute toward an efficient supply chain process, with better monitoring and tracking capabilities. The use of the RFID tags, therefore, can help to more easily track, monitor and control the location of the pallets throughout the entire supply chain system, as well as potentially the load the pallet is carrying, and other information of interest such as weight and size of the load.

These tags utilized with the pallet system of the invention may come in several options, including as example the following two ways:

(1) Active RFID:

FIGS. 10 and 11 are illustrations of some of the active RFID tags available in the market. The pallets 50 of the invention are designed in such a way so as to accommodate these tags so that any stored items on these pallets 50 can be scanned using these tags. The ability to identify a particular pallet, as well the ability to have readily available and current information as to the nature of the boxes, products or other material on the pallet, coupled with the real time location and position of the pallet, is a very useful tool in the management, storage and transportation of products in the system, as well as their retrieval and movement.

Current methods may comprise the scanning of individual boxes, which are located on the pallet, to identify and process the inventory. But using these RFID tags which are installed on a pallet system, or have mechanisms which enable them to fit on or into the pallet, makes it possible to store all the information of the items loaded on the pallet. The pallet may have a permanent tag fixed thereto, or a dedicated tag may be associated with a pallet for a given load as it moves through the system. Further, both such tags, or a plurality of such tags each for different purposes, may be used if this may improve efficiency and the ability to track pallets and their loads as they move through the system.

(2) Passive RFID

Passive RFID is one which may be molded into the pallet. These are unique RFIDs which need to withstand high heat and pressure. These tags again help to manage the inventory as well as protecting the pallet against any theft. Some of the Passive RFID tags are shown in FIG. 12 of the drawings.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

The invention claimed is:

1. A pallet comprising:

an upper load supporting surface having a peripheral edge;

a lower surface having a peripheral edge, the lower surface having substantially the same dimensions as the upper load supporting surface;

a plurality of peripheral supports at or near the peripheral edge of the lower surface and extending substantially upwardly therefrom to the upper load supporting surface so that the upper load supporting surface and the lower surface are spaced from each other and define sides of the pallet;

at least one internal support extending upwardly from the lower surface to the upper load supporting surface;

each side of the pallet having a first opening and a second opening adjacent to the first opening, each of the first and second openings being defined by the upper load supporting surface, the lower surface, and a pair of peripheral supports, each of the first and second openings comprising a through channel having a top wall, a bottom wall, a left side wall, a right side wall, and a beveled corner wall between the top wall and left and right side walls and the bottom wall and the left and right side walls, all of the walls being substantially planar and extending through the entire length of the through channel; and inclined surfaces on all of the walls extending from the peripheral edge of the upper load supporting surface and the lower surface.

2. A pallet as claimed in claim 1 wherein the upper load supporting surface is directly above the lower surface, and spaced therefrom by the peripheral supports.

3. A pallet as claimed in claim 1 wherein the upper load supporting surface comprises a grid over at least a portion of its surface.

4. A pallet as claimed in claim 1 wherein the lower surface comprises four outer pieces arranged at right angles to each other to form a rectangle, a first transverse piece extending between two opposite outer pieces and a second transverse piece extending between two other opposite outer pieces, the first transverse piece and the second transverse piece crossing and connected to each other at an approximate midpoint of the pallet.

5. A pallet as claimed in claim 1 wherein at least some of the peripheral supports are located at a corner of the pallet, and further comprising a center column support extending between the lower surface and the upper load supporting surface, wherein the center column support is located at substantially the midpoint between a pair of the peripheral supports.

6. A pallet as claimed in claim 4 wherein the inclined surfaces on the lower surface are formed on the four outer pieces, the first transverse piece, and the second transverse piece, the inclined surfaces being positioned on a travel pathway of a forklift.

7. A pallet as claimed in claim 1 wherein the first opening and the second opening have an elongate rectangular configuration, and the upper load bearing supporting surface and the lower surface at the first opening and the second opening have inclined surfaces.

8. A pallet as claimed in claim 4 further comprising an internal column extending between the lower surface and the upper load supporting surface, the internal column having a height so that it maintains the size of the space therebetween and provides additional support to the upper load supporting surface.

9. A pallet as claimed in claim 1 wherein upper load bearing surface and the lower surface are rectangular in shape, and the first opening and the second opening are located in all four of the sides of the pallet.

10. A pallet as claimed in claim 1 when comprised of materials selecting from the group consisting of plastic, wood, metal, or a combination of such materials.

11. A pallet as claimed in claim 1 wherein the first opening and the second opening are of elongate rectangular shape, wherein the corners thereof are beveled, and inclined surfaces are formed surrounding the first opening and the second opening to facilitate ingress and egress of a forklift entering the first opening and the second opening.

12. A pallet as claimed in claim 1 which can be raised by a forklift having two fork prongs, wherein one prong passes through the first opening and the other prong passes through the second opening.

13. A pallet as claimed in claim 1 further comprising an electronic tag programmable with information relating to location, load, and other parameters.

14. A pallet as claimed in claim 13 wherein the electronic tag comprise an RFID device.

15. A pallet as claimed in claim 13 wherein the RFID device is an active device for attachment and removal from the pallet and associated with the load.

16. A pallet as claimed in claim 13 wherein the RFID device is a passive device programmable and permanently affixed to the pallet.

17. A method of making a pallet comprising:

providing a lower surface;

placing an upper load bearing surface over the lower surface such that the lower surface and the upper load bearing surface are spaced from each other, the upper load bearing surface and lower surface forming sidewalls of the pallet;

placing peripheral support members between the lower surface and the upper load bearing surface to maintain the spaced relationship, the peripheral support members having sufficient strength to support loads placed on the upper load bearing surface;

forming on each side of the pallet a first opening and a second opening adjacent to the first opening, each of the first and second openings being defined by the upper load supporting surface, the lower surface, and a pair of peripheral supports, each of the first and second openings comprising a through channel having a top wall, a bottom wall, a left side wall, a right side wall, and a beveled corner wall between the top wall and left and right side walls and the bottom wall and the left and right side walls, all of the walls extending through the entire length of the through channel; and inclined surfaces on all of the walls extending from the peripheral edge of the upper load supporting surface and the lower surface.

18. A method as claimed in claim 17 further comprising the placement of an electronic device on the pallet, the electronic device being programmable with information relating to the position, location, and load details of the pallet.

19. A method as claimed in claim 18 wherein the electronic device comprises an RFID device releasably attached to the pallet and associated with the load thereon.

20. A method as claimed in claim 18 wherein the electronic device comprises an RFID device for permanent attachment to the pallet.

* * * * *